US005988780A

United States Patent [19]

Röck et al.

[11] Patent Number: 5,988,780

[45] Date of Patent: Nov. 23, 1999

[54] GUIDES FOR WITHDRAWAL OF DRAWERS

[75] Inventors: Erich Röck; Klaus Brüstle, both of Höchst, Austria

[73] Assignee: Julius Blum Gesellschaft m.b.H., Höchst, Austria

[21] Appl. No.: 08/945,350

[22] PCT Filed: Feb. 11, 1997

[86] PCT No.: PCT/AT97/00026

§ 371 Date: Oct. 24, 1997

§ 102(e) Date: Oct. 24, 1997

[87] PCT Pub. No.: WO97/31559

PCT Pub. Date: Sep. 4, 1997

[30] Foreign Application Priority Data

Feb. 26, 1996 [AT] Austria ..... 343/96

[51] Int. Cl.[6] ..... A47B 88/00

[52] U.S. Cl. ..... 312/334.46; 312/333; 312/334.1; 312/334.47

[58] Field of Search ..... 312/330.1, 333, 312/334.1, 334.44, 334.46, 334.7, 334.45, 334.47; 384/21

[56] References Cited

U.S. PATENT DOCUMENTS

| | | | |
|---|---|---|---|
| 2,726,905 | 12/1955 | Sundquist | 312/333 |
| 2,859,070 | 11/1958 | Gomersall | 312/333 X |
| 3,123,419 | 3/1964 | Maxwell | 312/333 |
| 4,749,242 | 6/1988 | Rechberg | 312/333 |
| 5,292,198 | 3/1994 | Rock et al. | 384/21 |
| 5,344,227 | 9/1994 | Röck . | |

FOREIGN PATENT DOCUMENTS

| | | |
|---|---|---|
| 5-23763 | 4/1993 | Japan . |
| 7-213359 | 8/1995 | Japan . |

*Primary Examiner*—James R. Brittain
*Assistant Examiner*—Karlena D. Schwing
*Attorney, Agent, or Firm*—Wenderoth, Lind & Ponack, L.L.P.

[57] ABSTRACT

A pull-out guide assembly includes a support rail to be mounted on an article of furniture, a pull-out rail to be mounted on a drawer, and an intermediate rail positioned between the support rail and the pull-out rail. A driving roller is mounted on the intermediate rail and runs on running flanges of the support rail and pull-out rail. A locking device on the intermediate rail couples the intermediate rail to the pull-out rail during a rear portion of displacement movement of the pull-out rail into the article of furniture. A closing device is provided on one of the rails to move the intermediate rail and the pull-out rail that is coupled thereto by the locking device to a rearmost position. A clearance is defined and created between the driving roller and the running flange of the support rail to prevent operation of the driving roller during a rear portion of movement of the pull-out rail.

18 Claims, 12 Drawing Sheets

1,2,3
4

2,3
1

2,3
4
1

2,3
4
1

2
30
41
3
4
1

2
30
4
3
42
42
1

GUIDES FOR WITHDRAWAL OF DRAWERS

BACKGROUND OF THE INVENTION

The invention relates to a pull-out guide assembly for a drawer and including a supporting rail to be attached to a furniture wall, at pull-out rail to be attached to the drawer, and an intermediate rail arranged between such two rails on each side of the drawer. Rollers are arranged between the rails and transmit the load of the drawer between the rails. A locking device is mounted on the intermediate rail on at least one side of the drawer by means of which the intermediate rail and the pull-out rail can be coupled during a rear part of their displacement. A closing device preferably is mounted on the support rail and engages the intermediate rail in the rear part of its displacement to move the intermediate rail together with the pull-out rail coupled thereto into a rearmost position when the drawer is inserted.

EP 0 548 706 A1 discloses a pull-out guide for a drawer whereby a pull-out rail and a support rail are arranged on each side of the drawer. Rollers are mounted between the rails and transmit the load of the drawer from the pull-out rail to the support rail. A closing device is mounted on the support rail and engages the pull-out rail in the rear part of its displacement and moves the pull-out rail together with the drawer by means of a spring into its rearmost final position. This prevents a drawer which is not fully closed from protruding from the article of furniture. Further examples of such closing devices are described in EP 0 391 221 B1 and US-PS 52 07 781.

EP 0 664 984 A2 shows a differential pull-out guide for a drawer with a pull-out rail, a support rail and an intermediate rail running differentially between such two rails on each side of the drawer. The differential movement of the pull-out rails and the intermediate rails is controlled by means of a control cable. The support rail is provided with a closing device having a tilting member, which is acted upon by a spring and which engages a peg of the intermediate rail in the rear part of its displacement and moves the intermediate rail to its rearmost final position. By means of the control cable the pull-out rail is moved into the rearmost final position and the drawer is closed correctly. When the closing device engages the intermediate rail the latter is coupled to the pull-out rail. There is no relative motion between these two rails. In the front part of the displacement of the pull-out guide assembly, however, the pull-out rail, the intermediate rail and the support rail run differentially with respect to each other.

SUMMARY OF THE INVENTION

It is the object of the invention to provide an improved pull-out guide assembly of the afore-mentioned type including a pull-out rail, a differentially running intermediate rail and a support rail, but such that an improved transition to the differential movement of the rails is achieved when the closing device is released and such that this differential movement is subsequently controlled. Such object is achieved in that a driving roller is mounted on the intermediate rail and runs on running flanges of the support rail and the pull-out rail and in that a clearance is provided between the driving roller and the support rail at a position or area to render the driving roller inactive.

BRIEF DESCRIPTION OF THE DRAWINGS

In the following embodiments of the invention will be described in detail with reference to the accompanying drawings, wherein.

DETAILED DESCRIPTION OF THE INVENTION

Figure 1:
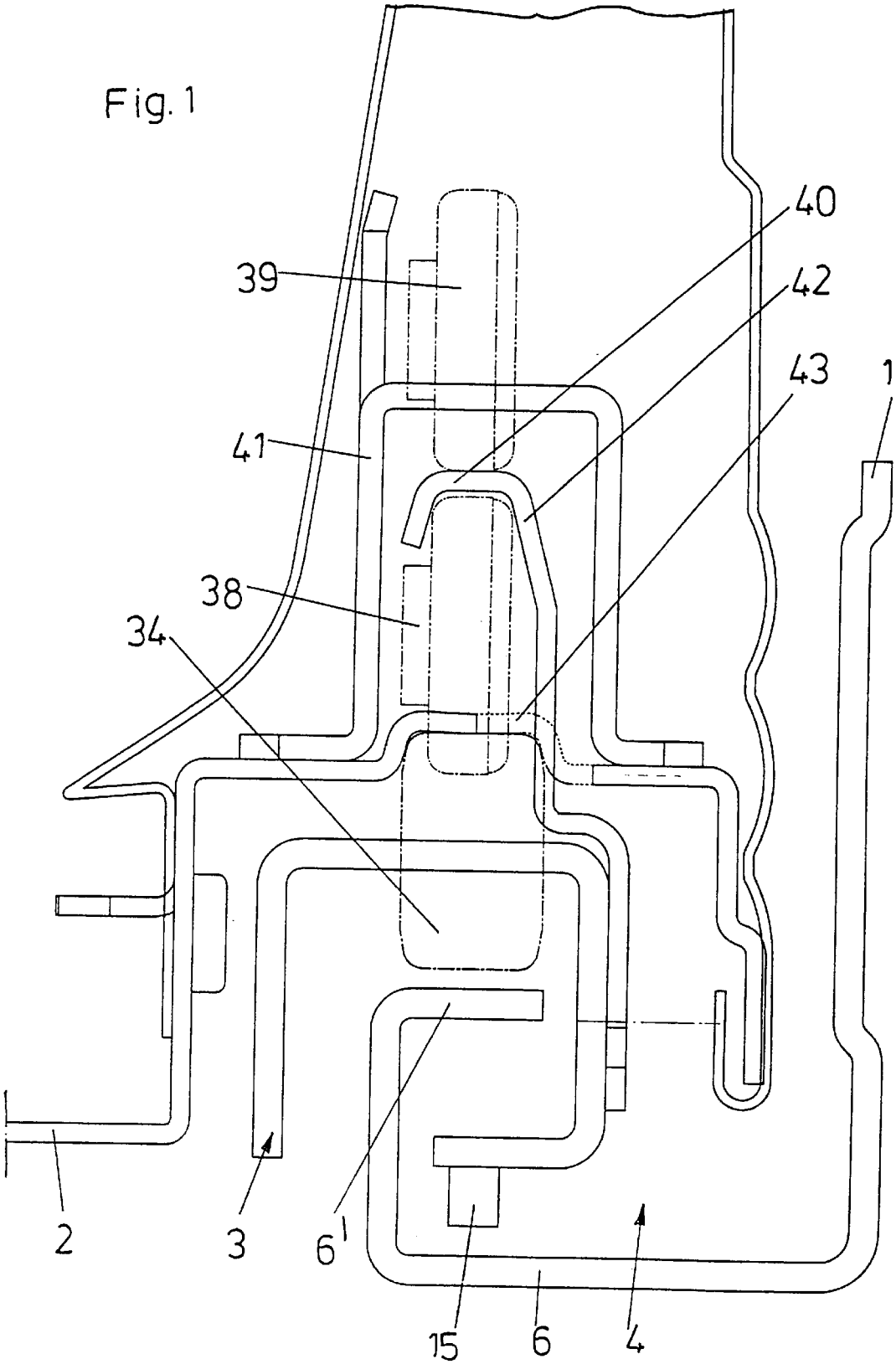
FIGS. 1 and 2 are cross sectional views of a pull-out guide assembly according to the invention.

On each side of the drawer is a support rail 1 to be fastened to a respective side wall of an article of furniture, a pull-out rail 2 to be fastened to a drawer, and an intermediate rail 3 that runs between the two rails 1, 2. Such pull-out guide assembly also includes a driving roller 4 mounted on the intermediate rail 3. In this way, when coupling between the intermediate rail 3 and the pull-out rail 2 is released, differential running between the support rail 1, the intermediate rail 3 and the pull-out rail 2 is achieved.

During closing and opening movement of the drawer the driving roller 4 runs between a running flange 5 of the pull-out rail 2 and a running flange 6 of the support rail 1. By means of the driving roller 4 it is guaranteed that the pull-out rail 2 is moved twice as fast as the intermediate rail 3 with respect to the support rail 1. The driving roller 4 is mounted on the intermediate rail 3 by means of an axle 7. Mounting without an axle would be possible by means of a bracket or by means of flaps stamped out of the intermediate rail 3.

Load transmitting running rollers between the support rail 1 and the intermediate rail 3 are mounted in separate roller carriages, which are not shown. A running roller 34 on which runs running flange 5 of the pull-out rail 2 is mounted at the front end of the intermediate rail 3. At the rear end of the pull-out rail 2 are mounted running rollers 38, 39 that embrace running flange 40 of the intermediate rail 3.

Figure 15:
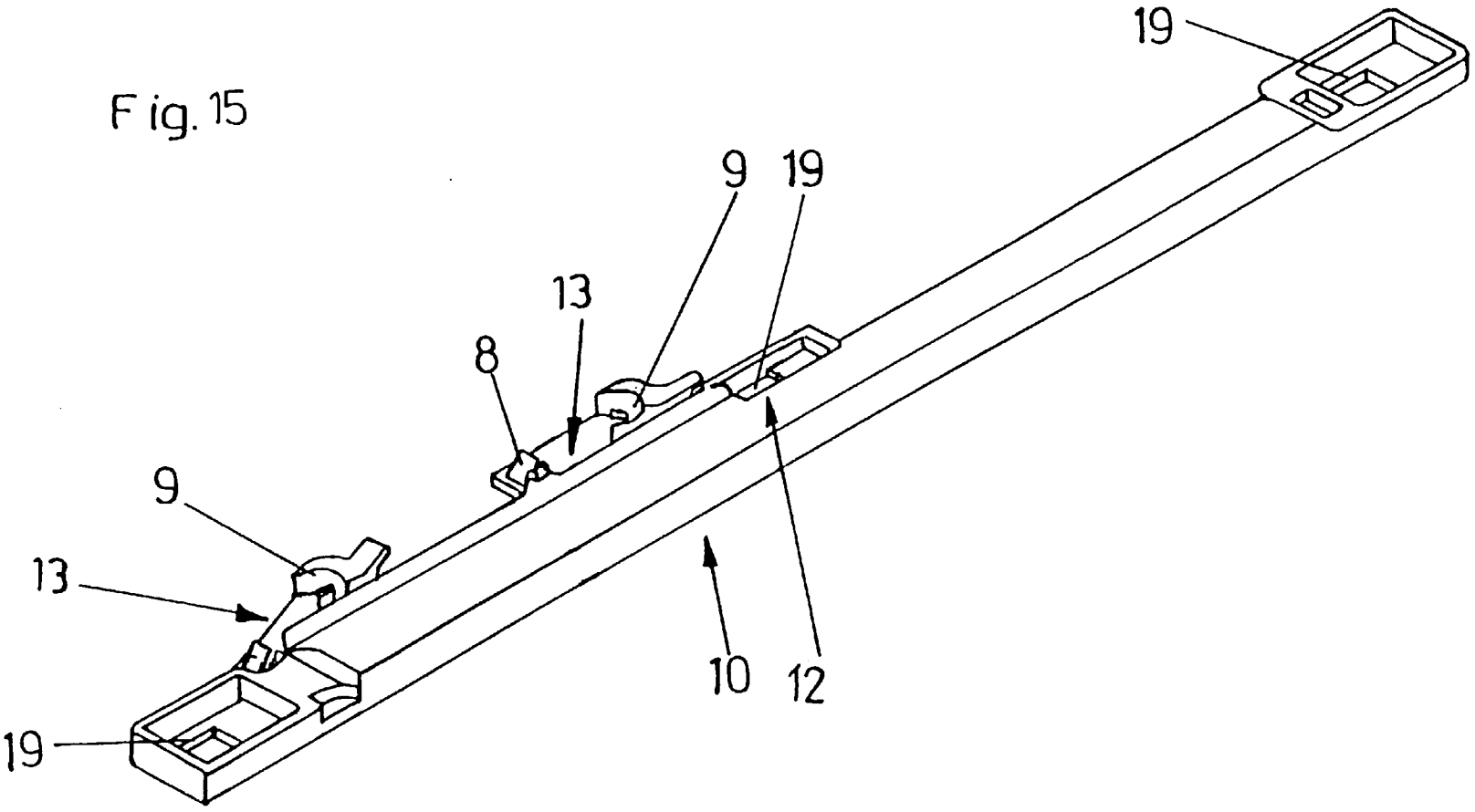
FIG. 15 is a perspective view of the closing device.

On at least on one side of the drawer, a closing device 10 is mounted on the respective support rail 1. The closing device 10 (FIGS. 15 and 16) includes guide housing 12, a tilting member 13, a guideway 14, and a spring 16 which is a helical tension spring. The guideway 14 is in the form of a groove situated in the guide housing 12. A retainer peg 15 is positioned on the intermediate rail 3 of the pull-out guide assembly. The tilting member 13 is guided in the guideway 14 by means of two pegs 18. The guideway 14 includes a rear elongated rectilinear section 14' and a front arcuate section 14". One end of spring 16 is hooked to a peg 11 of the guide housing 12.

Figure 16:
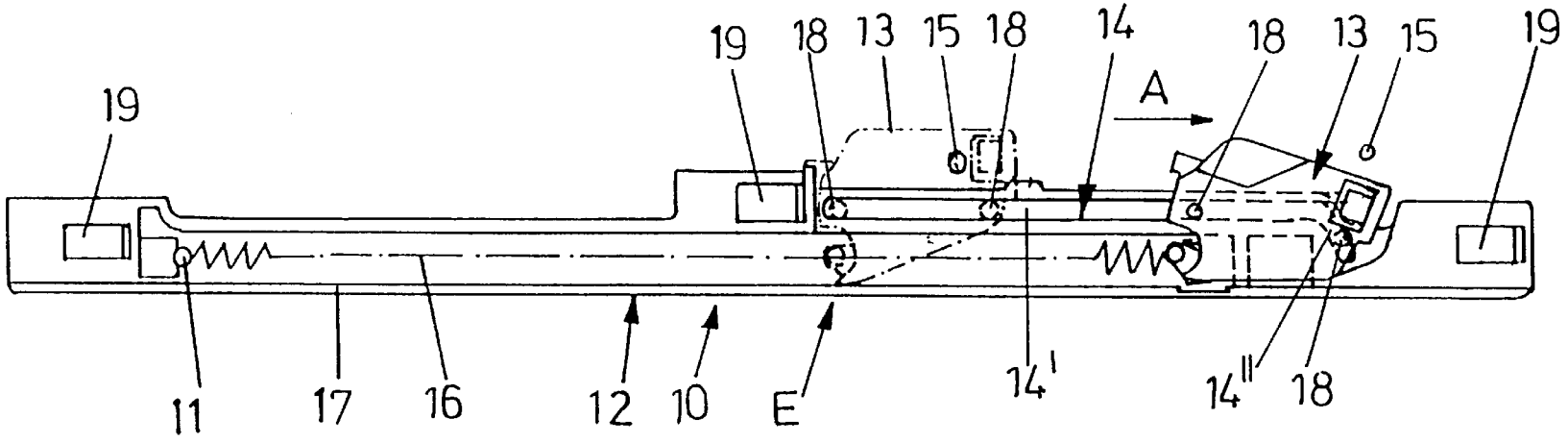
FIG. 16 is a schematic view of the closing device as viewed from below.
Figure 17:
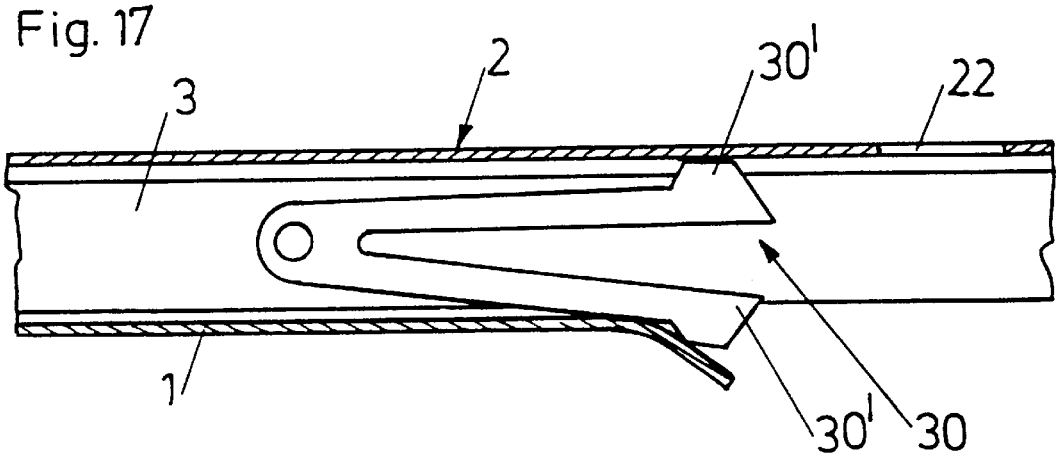
FIGS. 17 and 18 are side views of a tilting lever during normal operation.
Figure 18:
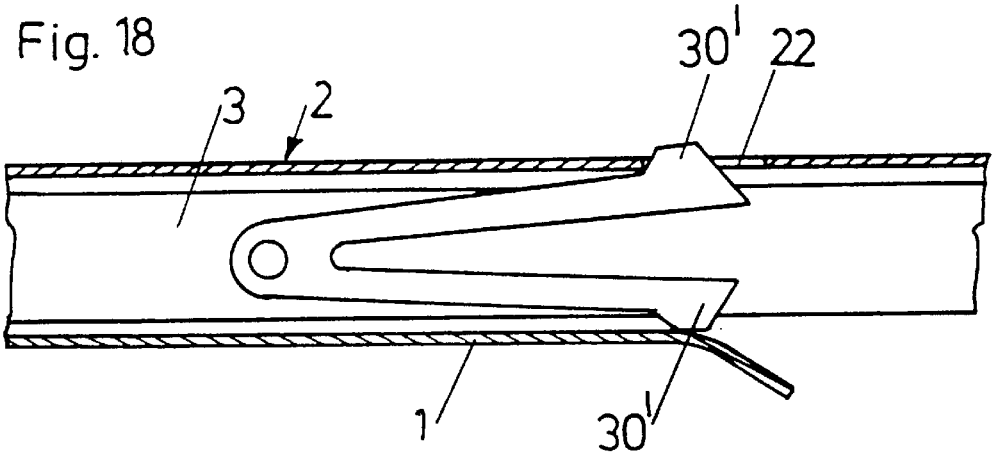

When the drawer is closed, the tilting member 13 is in the position indicated at E in FIG. 16 and the retainer peg 15 of the intermediate rail 3 protrudes into a slot 9 of the tilting member 13, the slot 9 being open at the top. When the drawer is pulled out, the tilting member 13 is moved first along the straight section 14' of the guideway 14 in the direction of the arrow A till it reaches the arcuate section 14" of the guideway 14. The tilting member 13 is tilted forwardly into section 14", such that retainer peg 15 no longer is in slot 9 and thus can continue forward movement beyond tilting member 13. By means of the guidance provided between the two pegs 18 and the dimension of the arc of the section 14", the tilting member 13 is locked in its front position when the drawer is extended or pulled out. That is, tilting member 13 is not automatically retracted or pulled back by the spring 16.

During movement the pull-out rail 2 is coupled to the intermediate rail 3 by means of a locking device and is moved together with rail 3. The driving roller 4 is not active. After the tilting member 13 has released the retainer peg 15, the locking device is released and the driving roller 4 becomes active, so that the pull-out rail 2 is moved twice as fast as the intermediate rail 3. When the drawer is pushed in, the pull-out rail 2 is at first moved differentially with respect to the intermediate rail 3, whereby the movement of the rails 2, 3 is controlled by the driving roller 4. In a rear portion of this displacement just before the retainer peg 15 reaches the tilting member 13, the driving roller 4 is put out of action and the locking device couples the pull-out rail 2 with the intermediate rail 3. When the retainer peg 15 again engages in the slot 9 of the tilting member 13 the tilting member 13 is moved rearwardly by the pushing force of the peg 15. As soon as the tilting member 13 has been moved out of the arcuate section 14" and is in the straight section 14' of the guide way 14 the spring 16 comes into effect. That is to say, whereas the tilting member 13 is first moved by the movement of the drawer, the force of the spring 16 can now be transmitted to the drawer by way of the tilting member 13, the retrainer peg 15 and the locking device between the intermediate rail 3 and the pull-out rail 2. That is, the spring 16 pulls the tilting member 13 and the drawer into the furniture body. In this way a drawer which has been pushed in with little care will be pulled completely into furniture body, and the drawer panel is prevented from projecting outwardly.

The closing device 10 and therefore the guide housing 12 are mounted on a horizontal flange of the support rail 1, such horizontal flange also being the running flange 6. In the embodiments shown the groove like guideway 14 is located on the underside of the guide housing 12 and the tilting member 13 is positioned underneath the guide housing 12, that is between the guide housing 12 and the running flange 6 of the support rail 1. Parallel to the guideway 14 but projecting further rearwardly is provided a channel which receives the spring 16. The spring 16 is fully covered by the guide housing 12, is only extended and then contracted again with the restoring motion of the drawer, and it does not perform tilting movement of member 13. The tilting member 13 is substantially covered by the guide housing 12. Only a small part projects along the side of the guideway 14 from the guide housing 12. The guide housing 12 has three securing points 19, which are preferably located at least approximately at the same distance from each other. In this way necessary stability can be achieved when guide housing 12 is formed of relatively thin plastic material.

In the embodiment shown in FIGS. 3 to 6 the locking device according to the invention is a slide 20, which is mounted on the intermediate rail 3 and is vertically displaceable. Immediately in front of the closing device 10 a longitudinal slot 21 is provided in the running flange 6 of the support rail 1 which provides the clearance for the driving roller 4. In the situation shown in FIG. 6 the drawer is in its rearmost position. The retrainer peg 15 of the intermediate rail 3 is held by the tilting member 13 of the closing device 10 and is also in the rearmost position.

The slide 20 protrudes into a hole 22 in the running flange 5 of the pull-out rail 2, whereby the pull-out rail 2 is coupled with the intermediate rail 3. The driving roller 4 is in the region of the longitudinal slot 21 and is therefore free, that is, it does not run on the running flange 6 of the support rail 1 and is therefore out of operation. When the drawer and consequently the pull-out rail 2 is pulled out of the piece of furniture, edge 23 of the running flange 5 at the hole 22 abuts a rearward or left inclined surface 24 of the slide 20. As the slide 20 rests on the guide housing 12 of the closing device 10 it cannot escape downwardly and therefore transmits the pulling force of the pull-out rail 2 to the intermediate rail 3. The pull-out rail 2 and the intermediate rail 3 are pulled forwardly together.

Figure 4:
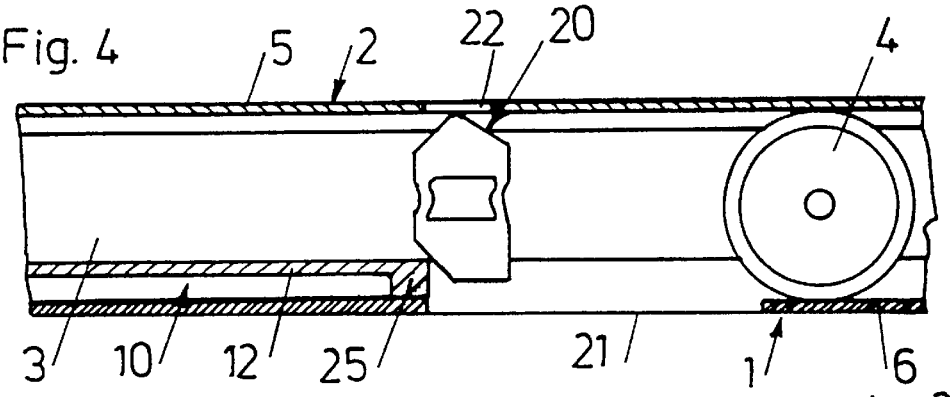
FIG. 4 is a side view the same as FIG. 3 but in a position close to locking an intermediate rail with a pull-out rail.
Figure 5:
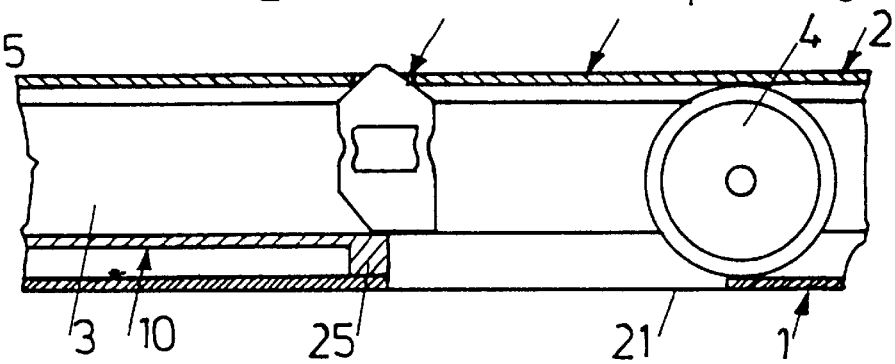
FIG. 5 is the same side view during locking of the pull-out rail with the intermediate rail.
Figure 6:
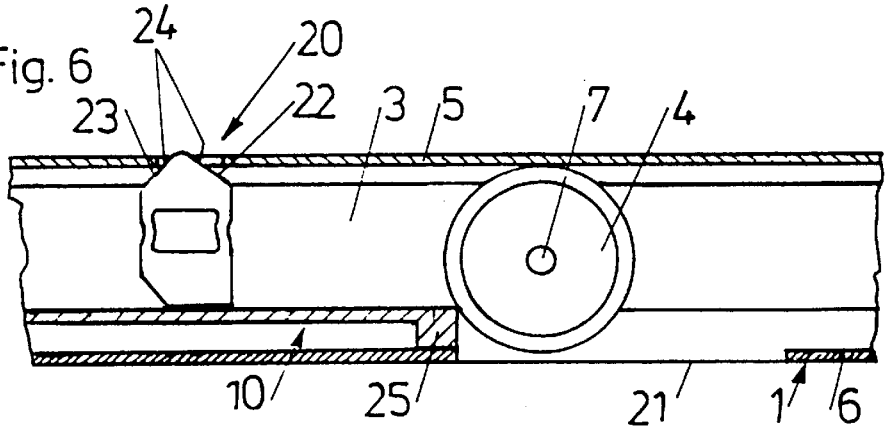
FIG. 6 is the same view, the rails of the pull-out guide assembly being in a fully inserted position.
Figures 7A, 7B, 7C, 7D, 7E, 7F:
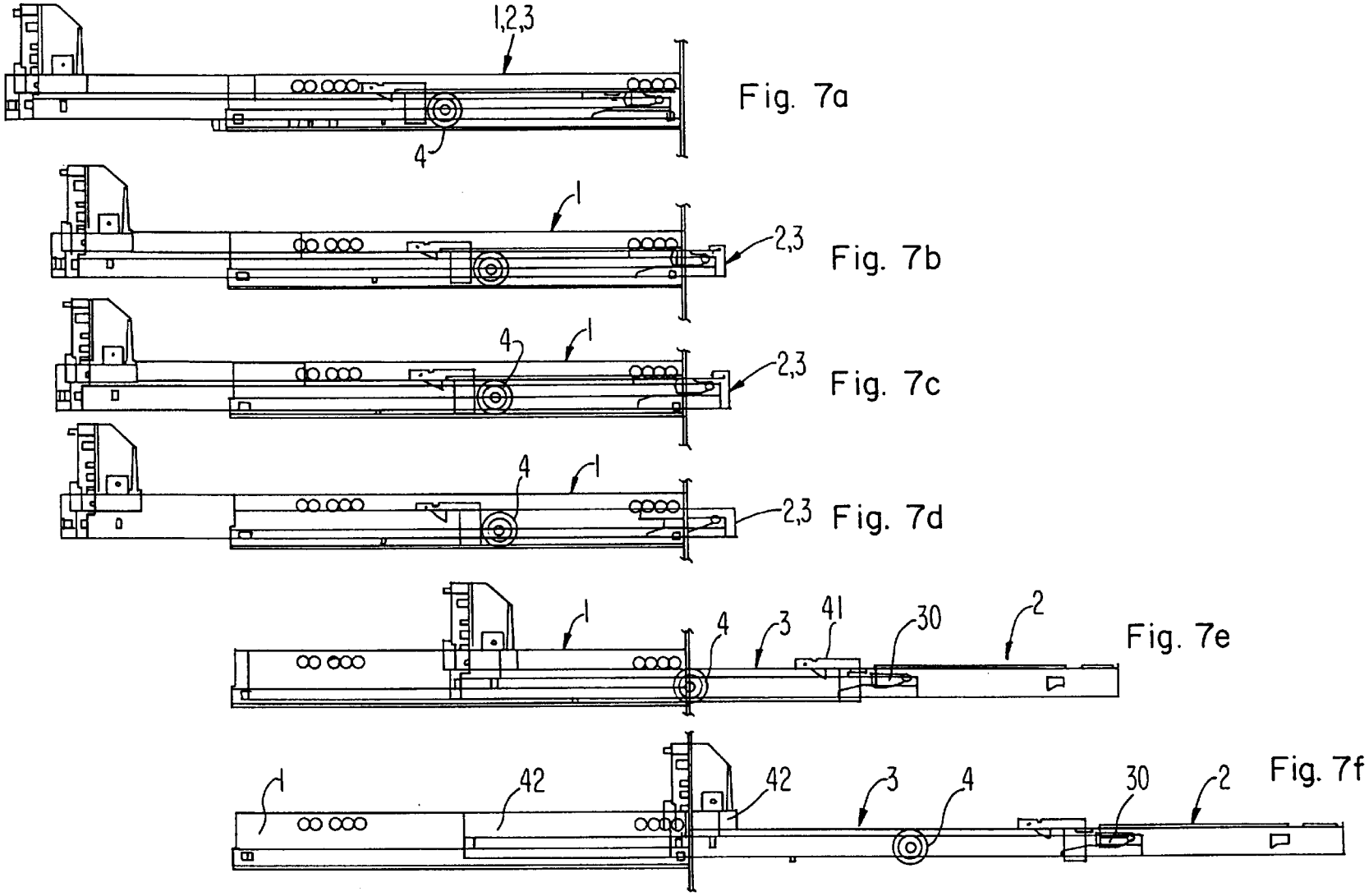
FIGS. 7*a* to 7*f* are side views of a pull-out guide assembly according to a further embodiment, and shown in respective in different positions along a displacement path from a fully closed drawer (FIG. 7*a*) to a position of a drawer being fully extracted (FIG. 7*f*)
Figure 8:
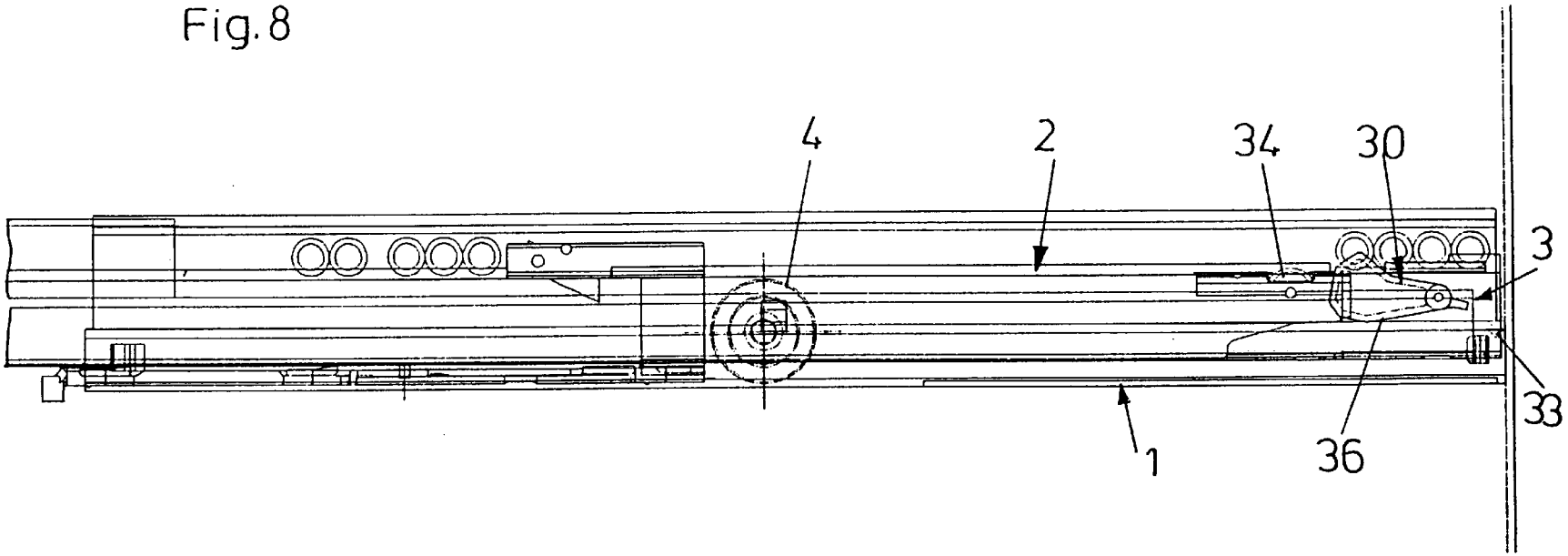
FIG. 8 is a side view at an enlarged scale of the position of FIG. 7*a;*

When the intermediate rail 3 and the pull-out rail 2 reach the position shown in FIG. 4, the driving roller rests 4 on the running flange 6 of the support rail 1 and the pull-out rail 2 is moved with respect to the intermediate rail 3. At the same time the slide 20 moves over the front edge 25 of the guide housing 12 of the closing device 10 and the slide 20 is pushed downwardly by the edge 23 of the running flange 5 of the pull-out rail abutting the inclined plane 24 of the slide 20 and releases the pull-out rail 2. At least approximately at the same time the tilting member 13 of the closing device 10 has reached its foremost position and releases the retainer peg 15.

Figure 3:
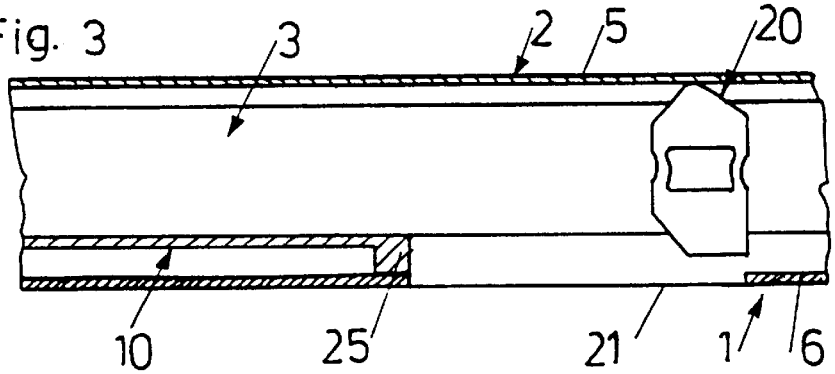
FIG. 3 is a side view of the pull-out guide assembly in the region of a locking device in a released position, the locking device being a slide.

The pull-out rail 2 and the intermediate rail 3 are now moved on differentially by means of the driving roller 4. The position of the slide 20, as shown in FIG. 3, is such that it is situated underneath the running flange 5 of the pull-out rail 2 and above the running flange 6 of the support rail 1.

The slide 20 is formed out of yielding elastic material, for example polyamide or polyurethane, so that in case the positions of the pull-out rail 2 and the intermediate rail 3 with respect to each other and to the support rail 1 are not correct, pull-out rail 2 can be pushed into the rear end position with the intermediate rail 3. Thereby the slide 20 is compressed between the running flange 5 of the pull-out rail 2 and the guide housing 12 of the closing device 10 and deformed. When the pull-out rail 2 also is in the correct position the slide 20 expands and projects with its top into the hole 22 in the running flange 5 of the pull-out rail 2. In the same way the position of the tilting member 13 can be corrected. On the tilting member 13 is provided a resilient lip 8. Lip 8 can be passed by the entrainer peg 15 of the intermediate rail 3 when the drawer is pushed in again if the tilting member 13 has been unintentionally pulled by the spring 16 from its front rest position into the rear end position E when the drawer was pulled out. If the drawer again is pulled out the entrainer peg 15 takes the tilting member 13 into the front end position and then is released. The next time the drawer is pushed in, the tilting member 13 is fully functional again and receives the retrainer peg 15 in the slot 9.

In the embodiment according to FIGS. 7 to 14 the locking device is a tilting lever 30 mounted on an axle 31 at the front end of the intermediate rail 3. It is provided with an upwardly projecting nose 32 and a lower stop plane 35.

An inclined slope 33 is formed at the front end of the running flange 6 of the support rail 1.

A stop is provided on the intermediate rail 3 which prevents the tilting lever 30 from tilting too far downwardly when it is not held by the support rail 1.

Figure 9:
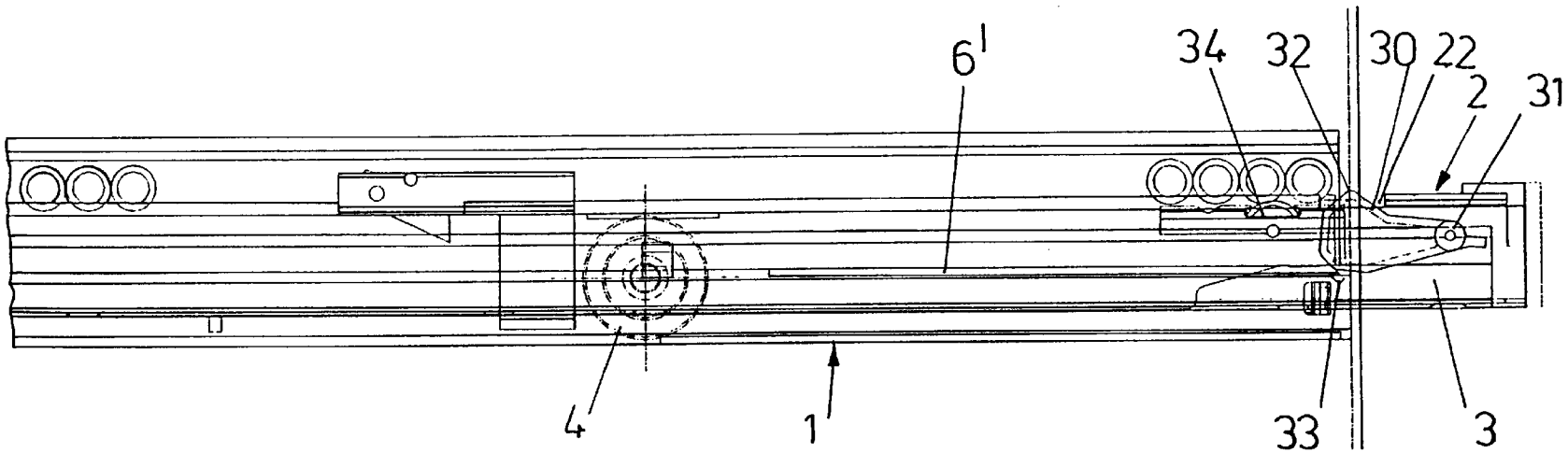
FIG. 9 is a side view at an enlarged scale of a front end of the pull-out guide assembly in the position of FIG. 7*c;*
Figure 10:
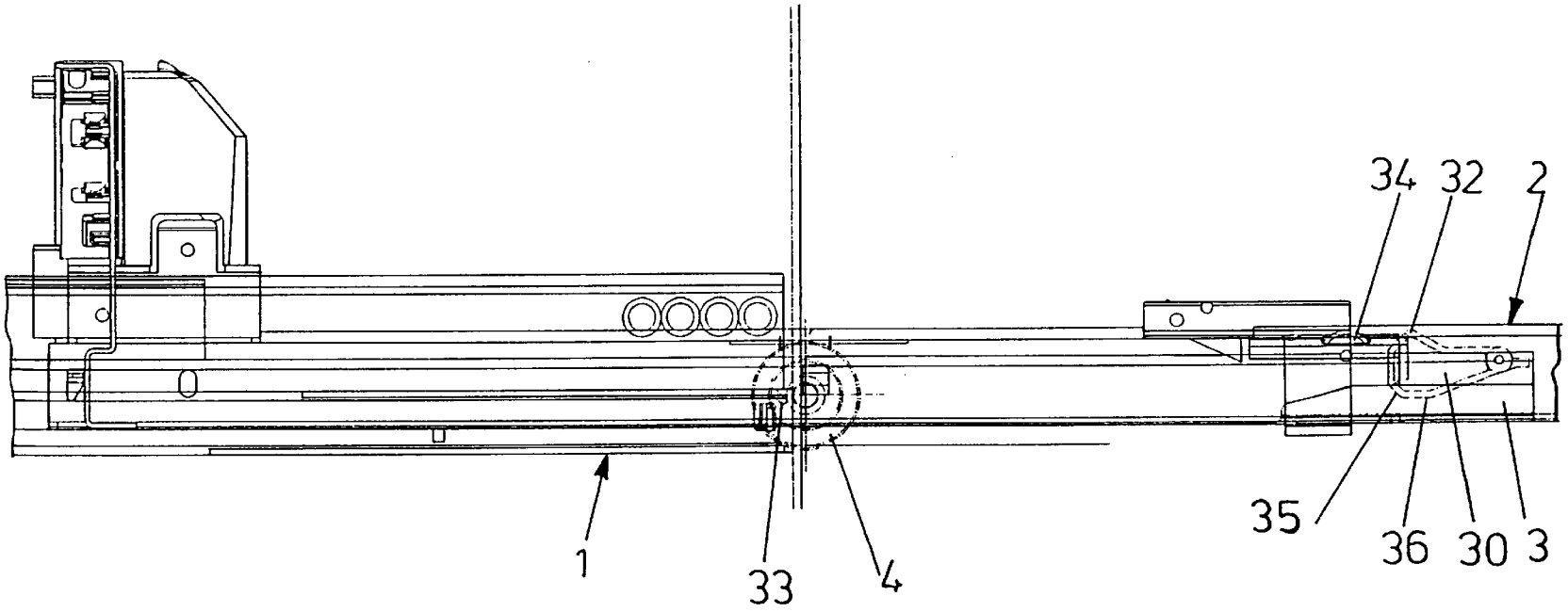
FIG. 10 is a side view of the pull-out guide assembly, shown at an enlarged scale, in the position of FIG. 7*a;*
Figure 11:
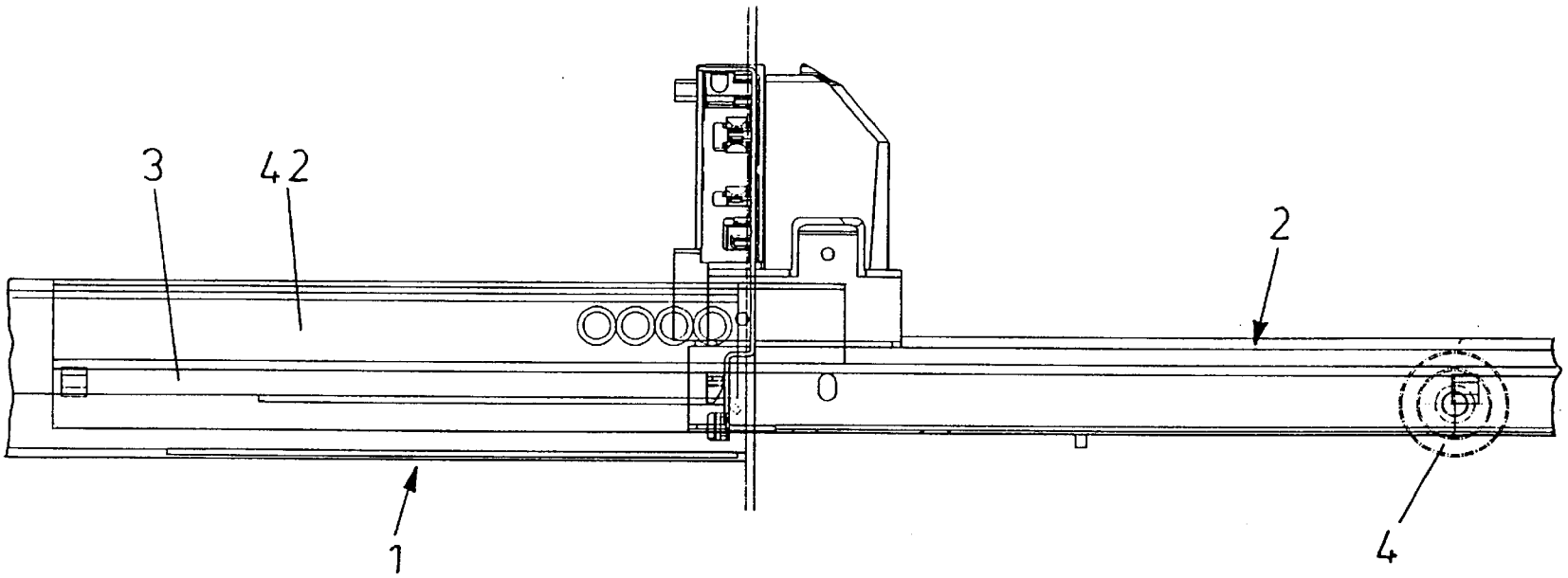
FIG. 11 is a side view of the pull-out guide assembly, shown at an enlarged scale, in the position of FIG. 7*f;*

If the tilting lever 30 meets the inclined plane 33 of the running flange 6 of the support rail 1 in the position shown in FIG. 9 it will be lifted by inclined plane 33 in such a way that the upwardly projecting nose 32 protrudes into the hole 22 in the running flange 5 of the pull-out rail 2. In this position the intermediate rail 3 and the pull-out rail 2 can again be brought into the rear most position by means of the closing device 10.

Figure 19:
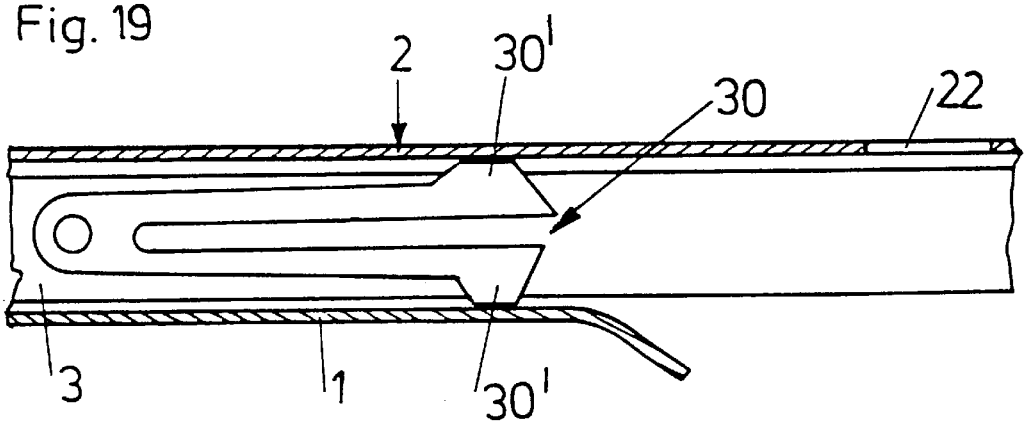
FIG. 19 is a side view of the tilting lever during mounting of the drawer.

The tilting lever 30 which is preferably made of polyurethane or polyamide is formed by an outer continuous rim 36 so that it is elastically deformable. By means of the elastic deformability of the tilting lever 30, it is, in the rear end position of the intermediate rail 3, possible to force the tilting lever 30 into the hole 22 of the pull-out rail 2 even when the rails 1, 2, 3 are not in the correct positions with respect to each other. This for example is the case when the drawer on which the pull-out rails 2 are mounted is inserted into the intermediate rails 3. Thereby the pull-out rails 2 are, as shown in FIG. 19, pushed over the tilting lever 30 which is deformed during this operation. The deformability of the tilting lever 30 can be increased by a fork-like structure. It is also possible to make the tilting lever 30 of two pieces with upper and lower arm 30' and to provide a spring between the arms 30'. After the rails 1, 2, 3 are again in their correct position with respect to each other coupling and releasing of the pull-out rail 2 and the intermediate rail 3 functions without deforming the tilting lever 30. The position of the driving roller 4 is chosen in the embodiments of FIGS. 2 and 12 to 14 in such a way that the driving roller 4 is, with a fully extracted drawer, situated at the front end of the support rail 1 and rests on the running flange 6 of the support rail 1 and the pull-out rail 2 rests with its rear end on the driving roller 4. The locking device, be it the slide 20 or the tilting lever 30, may be positioned in front as well as behind the driving roller 4. If the edge 25 of the closing device 10 is used for controlling the movement of the slide 20, the slide 20 is positioned behind the driving roller 4. If the front end of the upper running flange 6' of the support rail 1 is used for controlling the locking device, as in the embodiment according to FIGS. 7 to 11, the tilting lever 30 is positioned in front of the driving roller 4.

The distance between the locking device and the driving roller 4 can be chosen according to the desired handling characteristics.

On the one hand it is possible to chose the distance between the driving roller 4, the clearance for the driving roller 4 and the locking device in such a way that when the drawer is opened the locking device releases the pull-out rail 2 immediately when the intermediate rail 3 is released from the closing device 10, so that the pull-out rail 2 and the intermediate rail 3 are moved differentially at once after being released by the locking device.

However, it is also possible to choose the distances in such a way that after the closing device 10 has released the intermediate rail 3, the intermediate rail 3 and the pull-out rail 2 are moved further forwardly while being together coupled whereby the driving roller 4 does not function. Releasing of the pull-out rail 2 and the intermediate rail 3 as well as running of the driving roller 4 on the running flange 6 of the support rail 1 occur at a later time. Therefore, for the pull-out rail 2 of the drawer there are the following three phases: At first the pull-out rail 2 and the intermediate rail 3 are moved together forwardly against the force of the spring 16. Afterwards the closing device 10 releases the intermediate rail 3, and the pull-out rail 2 and the intermediate rail 3 are moved forwardly together while being coupled to each other till the coupling between the two rails 2, 3 is released and the intermediate rail 3 and the pull-out rail 2 are moved differentially with respect to the support rail 1 till they have reached the fully extended position.

However, in the embodiment according to FIGS. 7 to 11 there are the following sequences of movement: At first the pull-out rail 2 and the intermediate rail 3 which are coupled with each other are moved together forwardly against the force of the spring 16 of the closing device 10. Afterwards the closing device 10 releases the intermediate rail 3, and the driving roller 4 runs in the front area of the running flange 6 of the support rail 1. In this area the pull-out rail 2, the intermediate rail 3 and the support rail 1 are moved differentially with respect to each other. When the driving roller 4 leaves the running flange 6 of the support rail 1 at the forward portion of such movement, there is further movement of the pull-out rail 2 with respect to the intermediate rail 3 till rails 2 and 3 have reached the front end position. During this movement, however, the pull-out rail 2 and the intermediate rail 3 are not controlled differentially.

In the embodiment according to FIGS. 1 and 7 to 11 the running rollers 38, 39 are mounted on a mounting block 41. The intermediate rail 3 is at its rear end provided with an attachment 42 on which running flange 40 for the running rollers 38, 39 is formed.

The pull-out rail 2 is provide with a slot 43 which is open to the rear through which the attachment 42 of the intermediate rail 3 protrudes.

Figure 2:
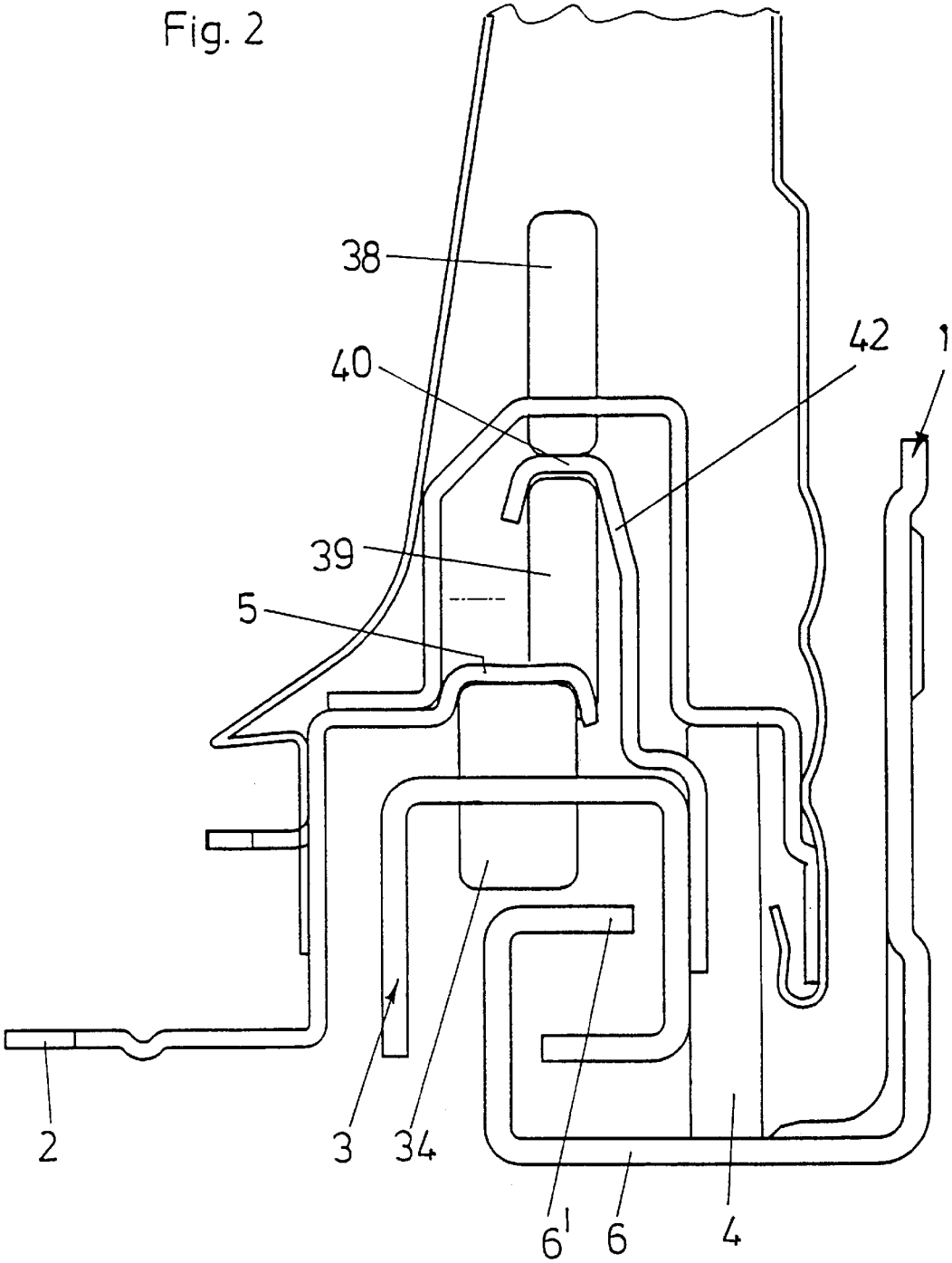
Figure 12:
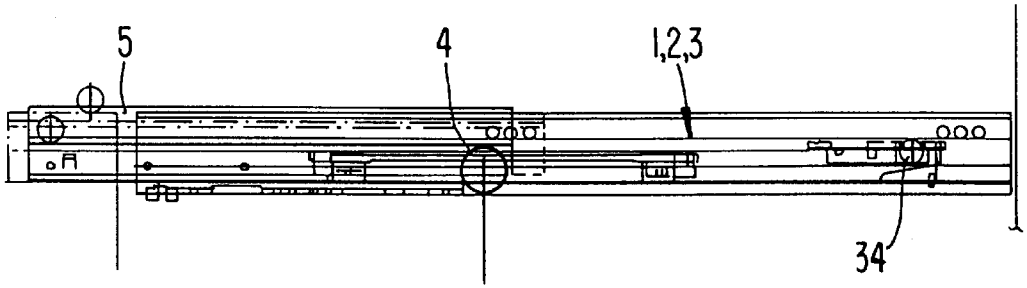
FIG. 12 is a side view of the pull-out guide assembly in a closed position.

In the embodiment of FIGS. 2 and 12 the pull-out rail 2 is provided with an attachment which covers the attachment 42 of the intermediate rail 3.

Figure 13:
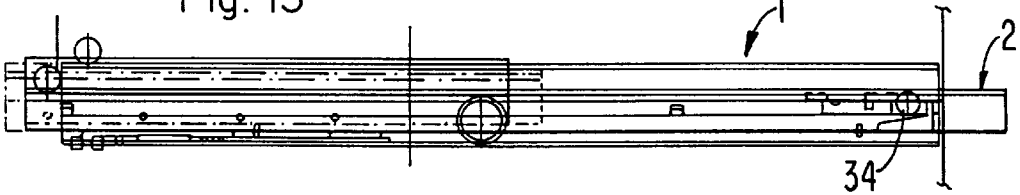
FIG. 13 is a side view showing the pull-out rail pulled a short way out of a piece of furniture.
Figure 14:
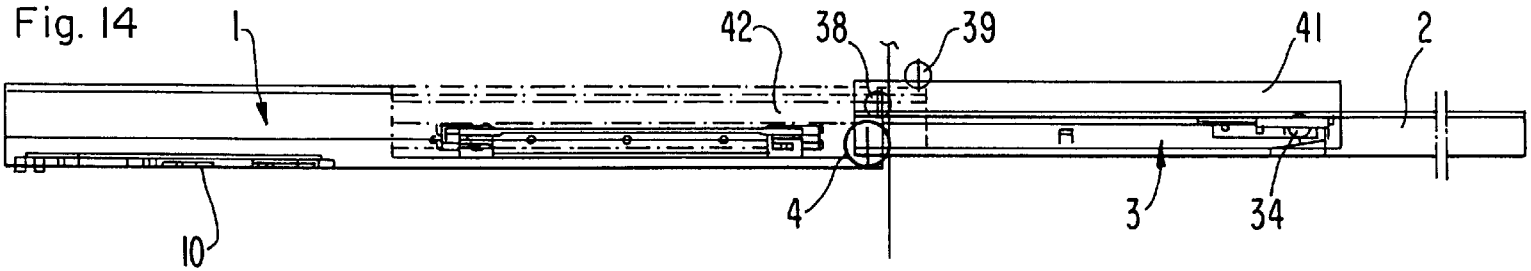
FIG. 14 is a side view of the pull-out guide assembly in a fully extracted position.

In the embodiment according to FIGS. 12 to 14 the driving roller 4 remains within the support rail 1 when the drawer is fully extracted. In these figures the locking device is not shown. It is constructed analogous to the other embodiments.

We claim:

1. A pull-out guide assembly for use on a side of a drawer for guiding movement of the drawer into and out of an article of furniture, said assembly comprising:

a support rail to be mounted on the article of furniture and having a running flange;

a pull-out rail to be mounted on the drawer and having a running flange;

an intermediate rail positioned between said support rail and said pull-out rail;

a driving roller mounted on said intermediate rail and running on said running flanges of said support rail and said pull-out rail and causing, upon longitudinal movement of said pull-out rail along a displacement path in withdrawal and inserting directions, longitudinal movement of said pull-out rail relative to said intermediate rail and longitudinal movement of said intermediate rail relative to said support rail;

a locking device on said intermediate rail to couple said intermediate rail to said pull-out rail at a rear portion of said displacement path of said pull-out rail;

a closing device on one of said rails to move said intermediate rail and said pull-out rail coupled thereto by said locking device to a rearmost position thereof when said pull-out rail is moved along said displacement path in said inserting direction; and a clearance between said driving roller and said running flange of said support rail to prevent operation of said driving roller at said rear portion of said displacement path of said pull-out rail.

2. An assembly as claimed in claim 1, wherein said clearance is defined by an opening in said running flange of said support rail.

3. An assembly as claimed in claim 2, wherein said opening comprises a longitudinal slot.

4. An assembly as claimed in claim 1, wherein said clearance is positioned directly forwardly of said closing device.

5. An assembly as claimed in claim 1, wherein said locking device comprises a slide that is movable to a locking position protruding into a hole in said running flange of said pull-out rail.

6. An assembly as claimed in claim 5, wherein said slide has upper and lower inclined planes, said pull-out rail has a stop member, said support rail has a stop member, and during movement of said pull-out rail along said displacement path said stop member of said pull-out rail abuts said upper inclined plane of said slide and said stop member of said support rail abuts said lower inclined plane of said slide.

7. An assembly as claimed in claim 6, wherein an upper end of said slide has two upper inclined planes that face in opposite directions.

8. An assembly as claimed in claim 6, wherein said closing device includes a housing mounted on said running flange of said support rail, and said housing defines said stop member of said support rail.

9. An assembly as claimed in claim 5, wherein said slide is elastically deformable and is made of a plastic material.

10. An assembly as claimed in claim 9, wherein said plastic material comprises polyamide or polyurethane.

11. An assembly as claimed in claim 1, wherein said locking device comprises a tilting lever mounted on said intermediate rail.

12. An assembly as claimed in claim 11, wherein said tilting lever includes an upwardly projecting nose that, in a locking position of said locking device, extends into a hole in said running flange of said pull-out rail.

13. An assembly as claimed in claim 11, wherein said tilting lever includes a free end that is directed rearwardly with respect to said withdrawal direction.

14. An assembly as claimed in claim 11, wherein said running flange of said support rail includes a downwardly inclined slope forming a guide surface for said tilting lever.

15. An assembly as claimed in claim 11, wherein said tilting lever is elastically deformable and is made of a plastic material.

16. An assembly as claimed in claim 15, wherein said plastic material comprises polyamide or polyurethane.

17. An assembly as claimed in claim 15, wherein said tilting lever includes an outer continuous rim.

18. An assembly as claimed in claim 1, wherein said closing device is mounted on said support rail and engages said intermediate rail when said intermediate rail is in an inserted position with respect to said support rail.

* * * * *